US008911299B1

(12) United States Patent
Day

(10) Patent No.: US 8,911,299 B1
(45) Date of Patent: Dec. 16, 2014

(54) BILLIARD RACK ASSEMBLY AND METHOD OF RACKING BILLIARD BALLS

(71) Applicant: Mark H. Day, Easley, SC (US)

(72) Inventor: Mark H. Day, Easley, SC (US)

( * ) Notice: Subject to any disclaimer, the term of this patent is extended or adjusted under 35 U.S.C. 154(b) by 77 days.

(21) Appl. No.: 13/692,166

(22) Filed: Dec. 3, 2012

(51) Int. Cl.
*A63D 15/00* (2006.01)

(52) U.S. Cl.
CPC ..... *A63D 15/005* (2013.01); *A63D 15/00* (2013.01)
USPC ..... 473/40

(58) Field of Classification Search
CPC ..... A63D 15/00; A63D 15/05
USPC ..... 473/40, 41, 21, 22, 26; D21/782–784
See application file for complete search history.

(56) References Cited

U.S. PATENT DOCUMENTS

| | | | | | |
|---|---|---|---|---|---|
| 464,745 | A | * | 12/1891 | Sweet | 473/40 |
| 501,256 | A | * | 7/1893 | Rohrbach | 473/41 |
| 743,464 | A | * | 11/1903 | D'Abramo | 473/40 |
| 850,360 | A | * | 4/1907 | Flint | 473/40 |
| 1,115,911 | A | * | 11/1914 | Dickinson | 473/40 |
| 1,299,471 | A | * | 4/1919 | Hornbostel | 473/40 |
| 1,725,494 | A | * | 8/1929 | Varnum | 473/40 |
| 2,405,677 | A | | 8/1946 | Volpe | |
| 3,253,826 | A | | 5/1966 | Cook | |
| 3,992,005 | A | * | 11/1976 | Richey | 473/40 |
| 4,903,965 | A | | 2/1990 | Smith | |
| 5,531,646 | A | * | 7/1996 | Boyle | 473/40 |
| 5,556,341 | A | | 9/1996 | Bonn, Jr. | |
| 5,601,496 | A | | 2/1997 | Beauchamp | |
| 5,735,750 | A | * | 4/1998 | Silverman | 473/40 |
| 5,997,404 | A | | 12/1999 | Sardo | |
| 6,312,342 | B1 | * | 11/2001 | Newsome | 473/40 |
| 6,595,862 | B2 | | 7/2003 | Porper | |
| 7,166,033 | B2 | * | 1/2007 | Krajeski | 473/40 |
| 7,731,596 | B1 | * | 6/2010 | Yovanovich et al. | 473/40 |
| 7,785,209 | B1 | * | 8/2010 | Targosz et al. | 473/40 |
| 8,216,078 | B1 | | 7/2012 | Yovanovich et al. | |
| 2005/0009614 | A1 | | 1/2005 | Knight | |
| 2007/0191124 | A1 | | 8/2007 | Thorpe | |

* cited by examiner

*Primary Examiner* — Mitra Aryanpour
(74) *Attorney, Agent, or Firm* — Schwartz Law Firm, P.C.

(57) ABSTRACT

A billiards rack assembly tightly organizes billiard balls on a table. The rack assembly comprises a rigid frame defining a ball containment area. An elongated pivoted racking bar is located at one end of the rigid frame. A handle is attached to the pivoted racking bar, and is adapted for being grasped by a user to move the racking bar between a downwardly pivoted ball-engaging position and an upwardly pivoted frame-removing position. In the ball-engaging position, the pivoted racking bar forces the billiard balls tightly together within the ball containment area towards an opposite end of the rigid frame, thereby reducing gaps between adjacent balls. In the frame-removing position, the pivoted racking bar is moved away from the billiard balls and the handle located to facilitate lifting and removal of the rack assembly from the table.

17 Claims, 10 Drawing Sheets

BILLIARD RACK ASSEMBLY AND METHOD OF RACKING BILLIARD BALLS

TECHNICAL FIELD AND BACKGROUND OF THE INVENTION

This invention relates broadly and generally to a billiard rack assembly and method of racking billiard balls. A conventional rack (or "triangle") is used to organize billiard balls on a table at the beginning of a billiards game. Generally, the balls are first placed within the area defined by the rack, tightened against the front apex of the rack by pressure with the fingers or thumbs against a back row of balls, and properly located on the table playing surface—e.g., at the foot spot. At that point, the rack is generally moved forward slightly to permit disengagement with the tightly organized balls and then lifted carefully from the table without touching or loosening the balls.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a billiards rack assembly for tightly organizing billiard balls on a table. The rack assembly comprises a rigid frame defining a ball containment area. An elongated pivoted racking bar is located at one end of the rigid frame. Means are provided to pivotably attach the pivoted racking bar to the rigid frame. A handle is attached to the pivoted racking bar, and is adapted for being grasped by a user to move the racking bar between a downwardly pivoted ball-engaging position and an upwardly pivoted frame-removing position. In the ball-engaging position, the pivoted racking bar forces the billiard balls tightly together within the ball containment area towards an opposite end of the rigid frame, thereby reducing gaps between adjacent balls. In the frame-removing position, the pivoted racking bar is moved away from the billiard balls and the handle located to facilitate lifting and removal of the rack assembly from the table.

According to another exemplary embodiment, the rigid frame is substantially triangular and comprises three equally-spaced corners. The corners are integrally formed together with opposing elongated side frame segments and an elongated rear frame segment. One of the corners defines a front apex of the frame. In alternative embodiments, the rigid frame may be other shapes including diamond, octagonal, square, rectangular, or the like.

According to another exemplary embodiment, the pivoted racking bar extends substantially continuously between rear corners of the triangular frame. When in the ball-engaging position, the pivoted racking bar engages a back row of organized billiard balls adjacent the rear frame segment and forces the billiard balls tightly forward with the ball containment area towards the front apex of the frame.

According to another exemplary embodiment, the means for pivotably attaching the pivoted racking bar comprises an elongated metal hinge located on the rear frame segment of the triangular frame. The hinge extends substantially continuously from one end of the racking bar to an opposite end of said racking bar. In alternative embodiments, the frame and racking bar are constructed of a molded plastic, and the means for pivotably attaching comprises a living hinge. Further alternative pivot attaching means may comprise any other hinge including, for example, barrel hinge, pivot hinge, concealed hinge, case hinge, flag hinge, strap hinge, H hinge, and the like.

According to another exemplary embodiment, means are provided for temporarily holding the pivoted racking bar in the frame-removing position.

According to another exemplary embodiment, the means for temporarily holding the pivoted racking bar comprises one or more magnets. Alternatively, the means for temporarily holding may comprise hook and loop fasteners, other complementary male and female fasteners, pressure-sensitive adhesive, friction joint, interfering shoulders or other structure, or the like.

According to another exemplary embodiment, a hinge spacer is located on the rear frame segment adjacent the hinge.

According to another exemplary embodiment, the front apex of the rigid triangular frame defines a frame-tilt cutout.

According to another exemplary embodiment, a plurality of gliders are located at a bottom of the rigid frame.

According to another exemplary embodiment, means are provided for removably attaching the handle to the pivoted racking bar. The means for attaching may comprise complementary screw threads.

According to another exemplary embodiment, the pivoted racking bar comprises a rubber ball-engaging strip extending longitudinally substantially from one end of the racking bar to the other.

In yet another exemplary embodiment, the present disclosure comprises a method for tightly organizing billiard balls on a table. The method comprises locating the billiard balls within a ball containment area defined by a billiards rack assembly. The billiards rack assembly comprising a pivoted racking bar. Using a handle attached to the pivoted racking bar, moving the pivoted racking bar downwardly to a ball-engaging position, such that the pivoted racking bar forces the billiard balls tightly together within the ball containment area, thereby reducing gaps between adjacent balls. From the ball-engaging position, the pivoted racking bar is then lifted to a frame-removing position, such that the pivoted racking bar is moved away from the billiard balls and the handle located to facilitate lifting and removal of the rack assembly from the table.

BRIEF DESCRIPTION OF THE DRAWINGS

Exemplary embodiments of the present invention will hereinafter be described in conjunction with the following drawing figures, wherein like numerals denote like elements, and wherein:

FIGS. 7, 8, 9, 10, 11, 12, 13, 13A, and 14 are sequential views demonstrating use and operation of the exemplary rack assembly for tightly organizing billiard balls on the playing surface of the billiards table.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
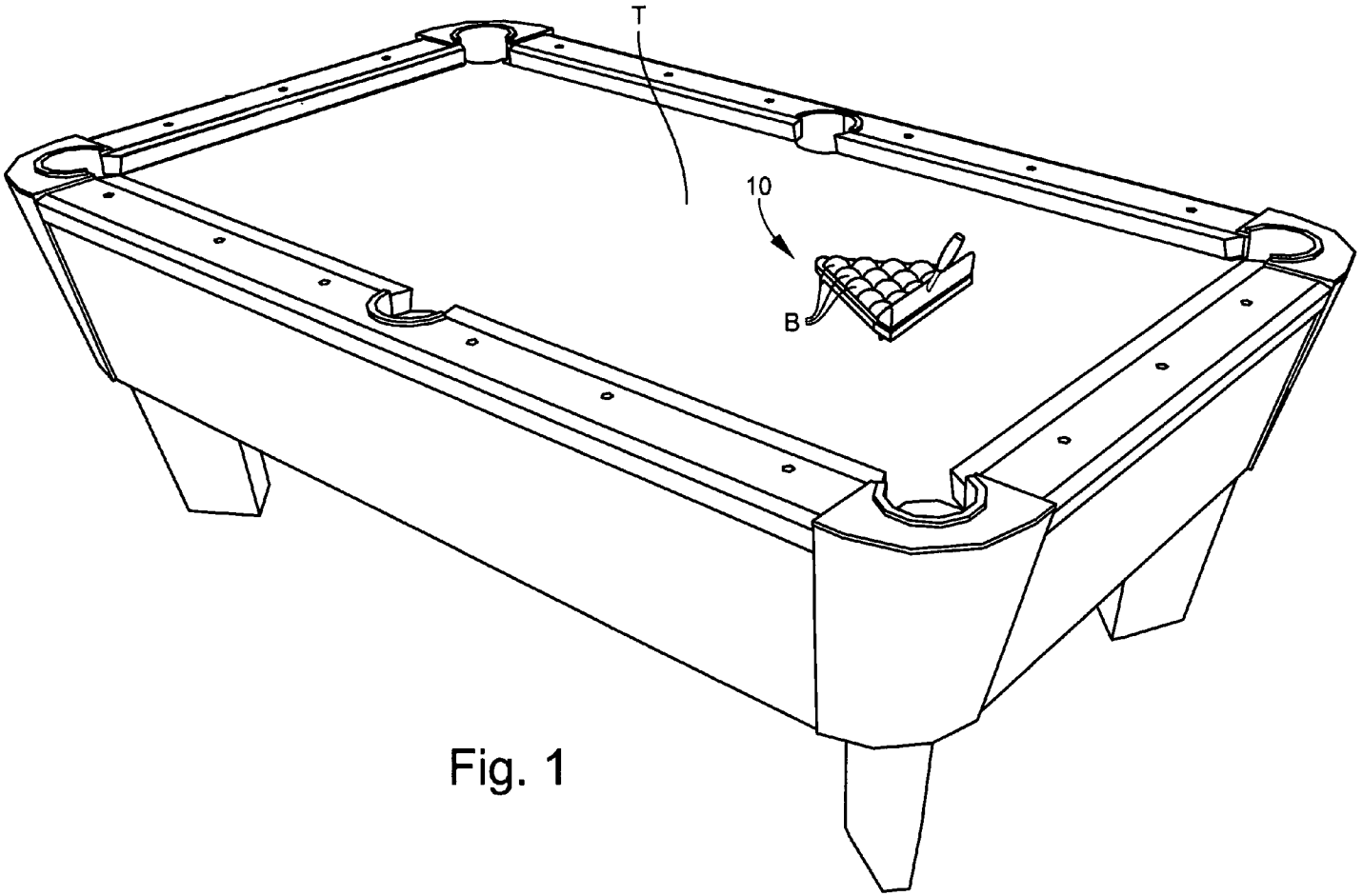
FIG. 1 is an environmental view of the exemplary rack assembly located on a billiards table.

Referring now specifically to the drawings, a billiards rack assembly according to one exemplary embodiment of the present disclosure is illustrated in FIG. 1, and shown generally at broad reference numeral 10. The rack assembly 10 serves to tightly organize or "rack" billiard balls "B" on the playing surface of a table "T" in a starting position of a billiards game. As commonly known and understood in the art, the technique of racking is an important aspect of billiards and can determine the effectiveness of the initial break. In any game of billiards, it is important to start off with a tight rack—meaning a tightly organized arrangement of balls with essentially no gaps between adjacent balls. Depending upon the game, the billiard balls may be between approximately 2 inches to approximately 2.5 inches in diameter—specifically, 2.25 inches for American billiards. Common games played on a pocket-billiards table include eight-ball, nine-ball, one-pocket and cutthroat.

Figure 2:
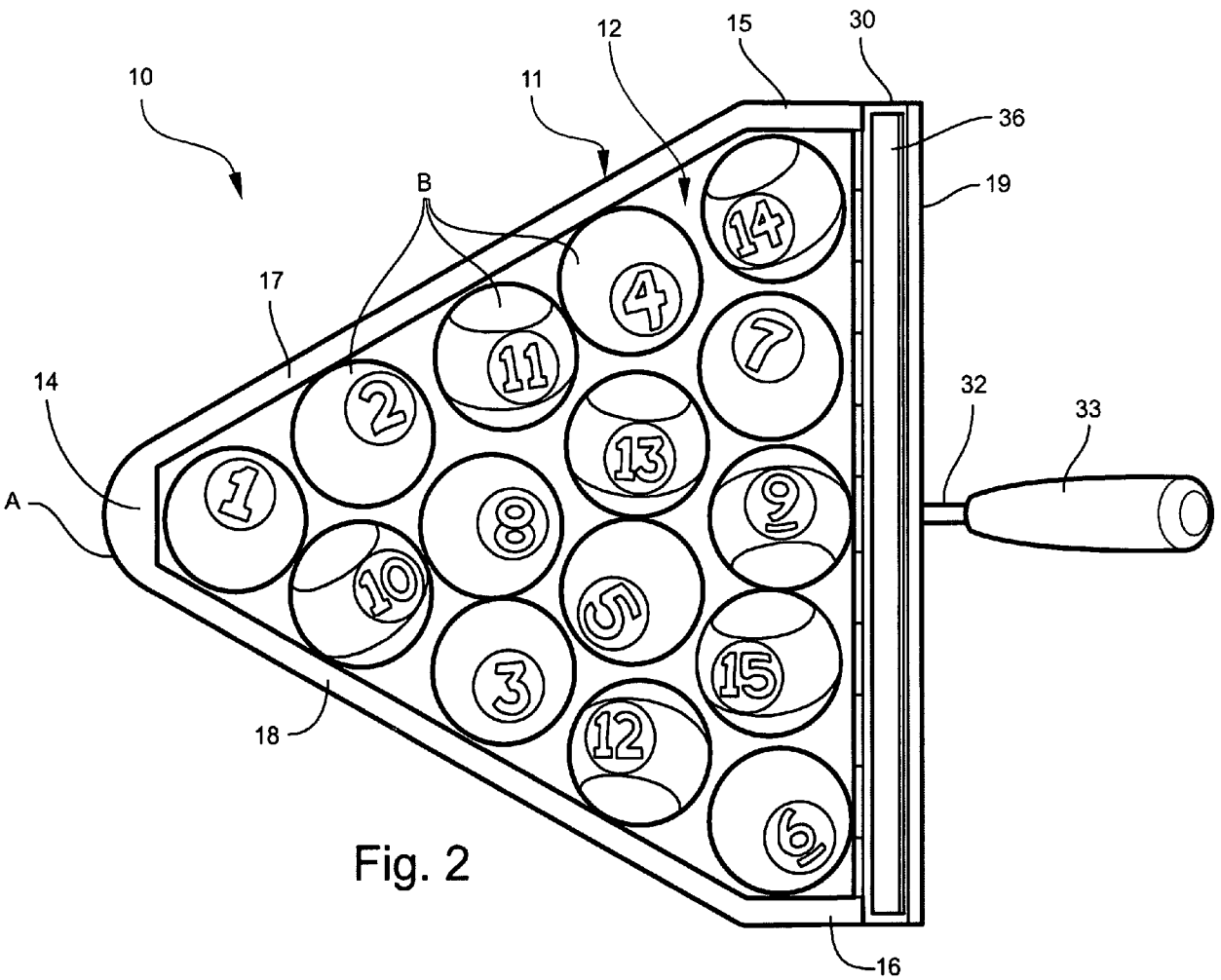
FIG. 2 is a top view of the rack assembly with billiard balls loosely organized within the ball containment area.
Figure 3:
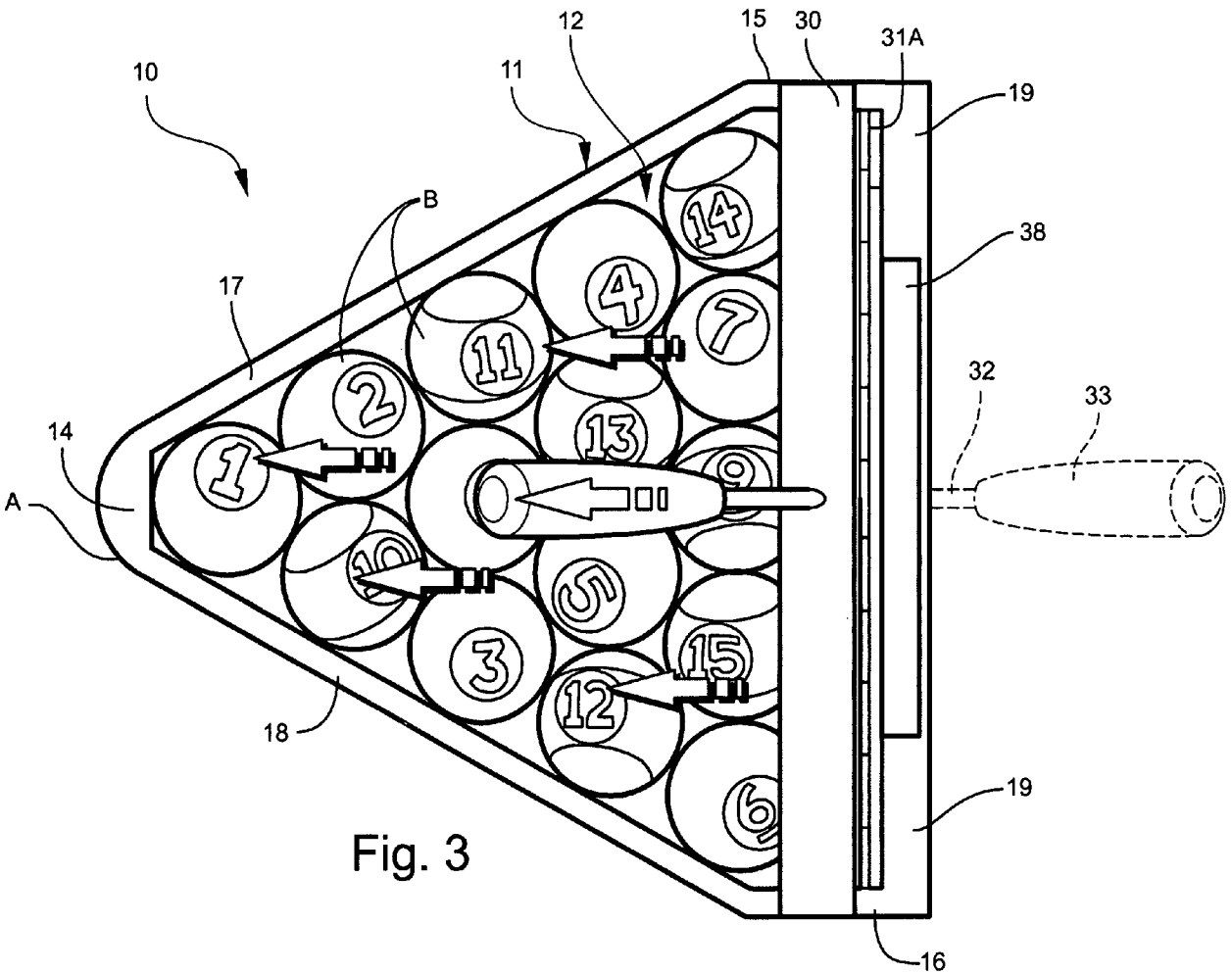
FIG. 3 is a view of the rack assembly demonstrating operation of the pivoted racking bar for moving the billiard balls together towards a front apex of the assembly.
Figure 4:
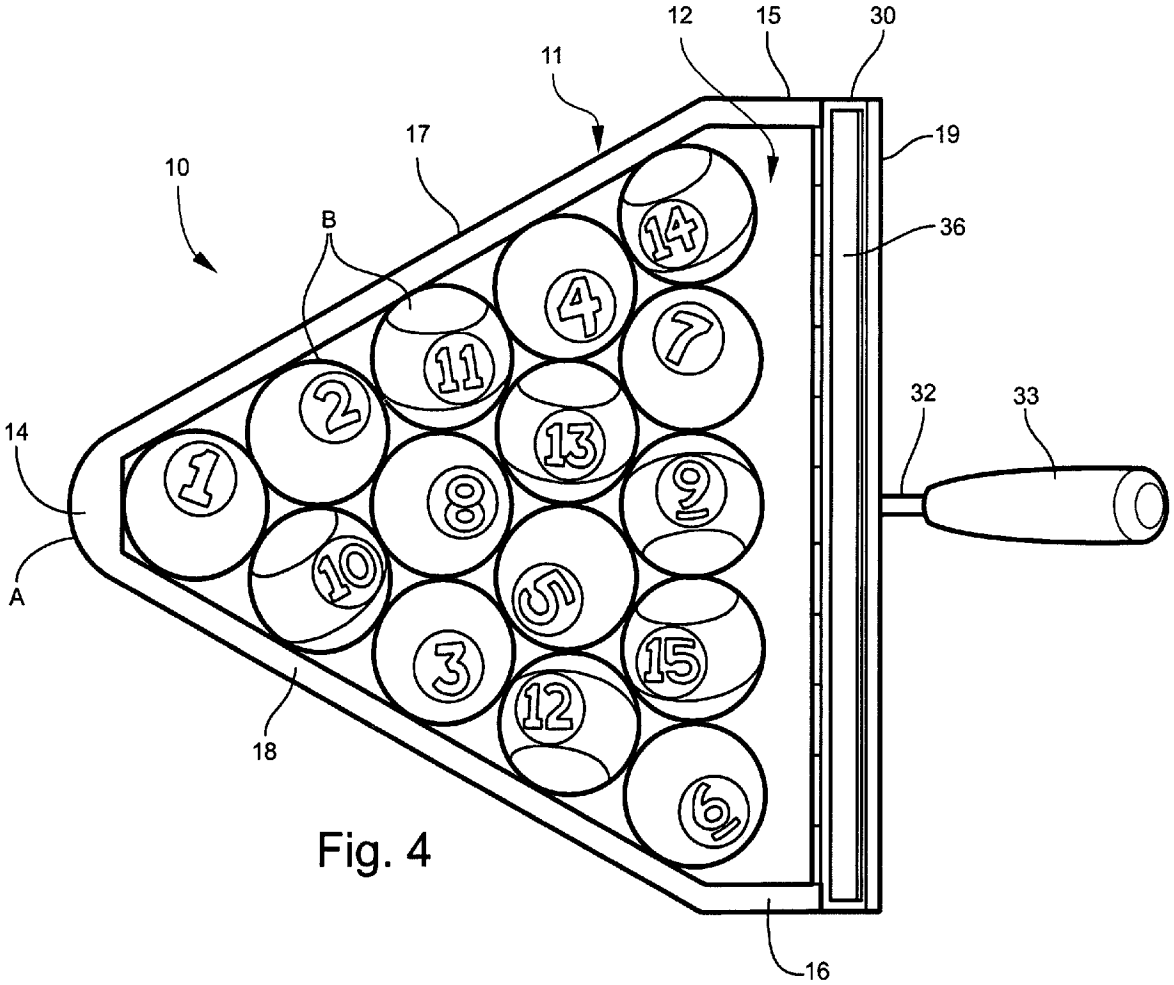
FIG. 4 illustrates the billiard balls in a tightly organized condition within the rack assembly.

As best shown in FIGS. 2, 3, and 4, the present rack assembly 10 comprises a closed-sided triangular rigid frame 11 defining a ball containment area 12 for organizing the billiard balls "B" on the table. The exemplary frame 11 includes three corners 14, 15, and 16, two elongated side frame segments 17 and 18, an elongated rear frame segment 19, and a plurality of bottom table gliders 21 (e.g., one at each corner—see FIGS. 7-14). The front corner 14 comprises an apex "A" of the rigid frame 11, and defines a front-tilt cutout 22 (FIGS. 7-14) to facilitate lifting and removal of the frame 11 from the table, as discussed further below. The frame corners 14-16 and segments 17-19 are integrally formed together of any suitable rigid material including carbonite plastic, acrylic, pine wood, maple, oak, mahogany, brass, aluminum, or the like. In the exemplary embodiment, the side frame segments 17 and 18 are approximately 10.5 inches and the rear frame segment 19 approximately 12.25 inches. In alternative embodiments, the rack assembly 10 may comprise a diamond or other geometrically shaped frame.

Figure 5:
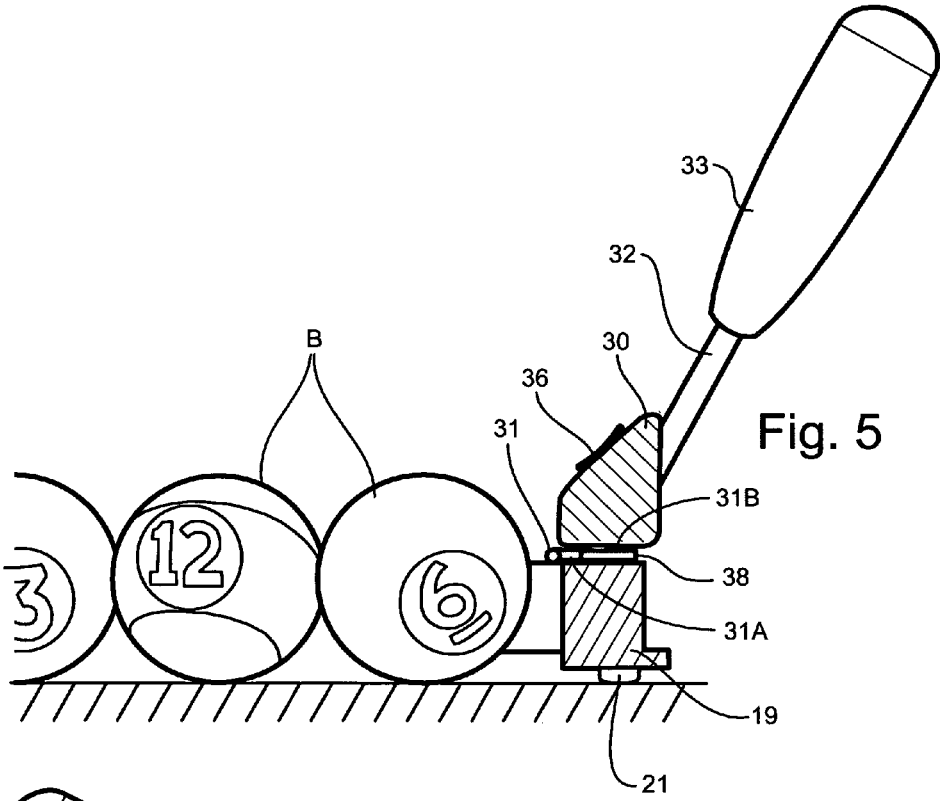
FIGS. 5 and 6 are fragmentary cross-sectional views of the rack assembly illustrating the pivoted racking bar and handle in the raised and lowered positions, respectively.
Figure 6:
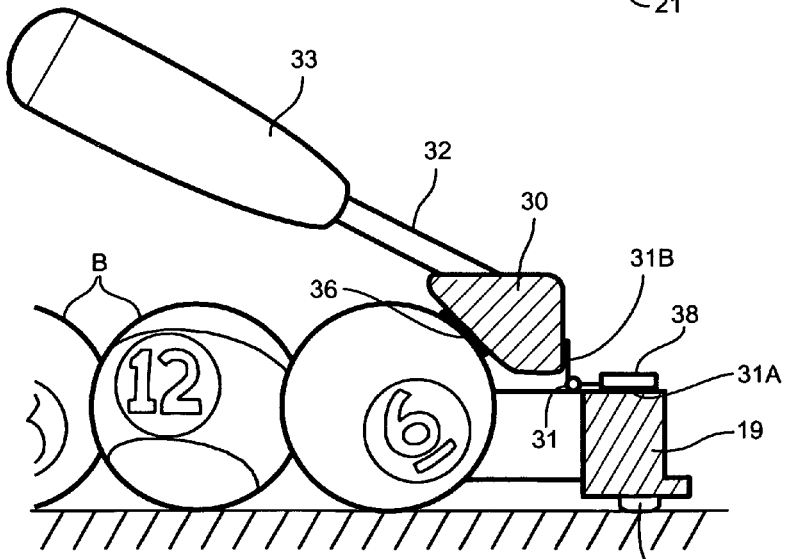
Figure 7:
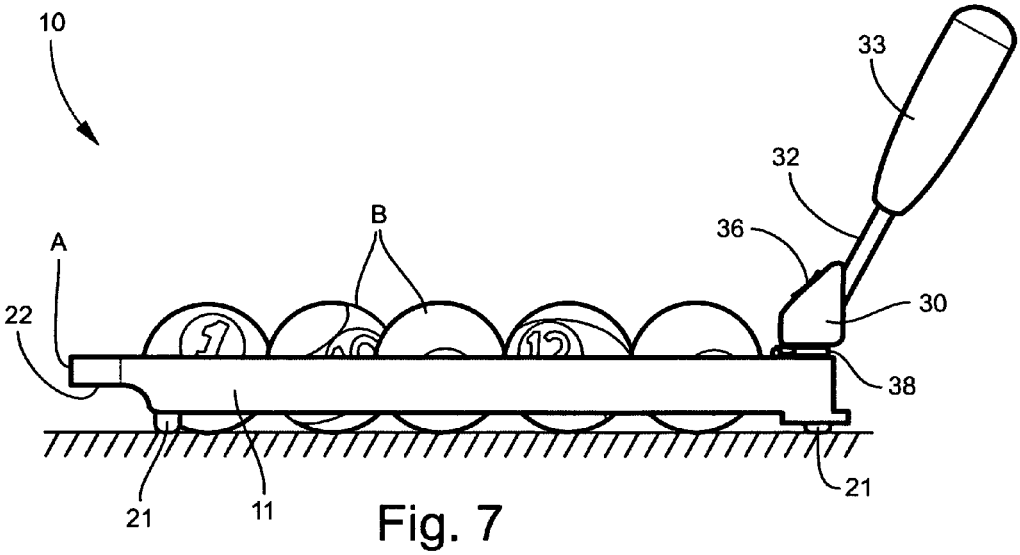
Figure 8:
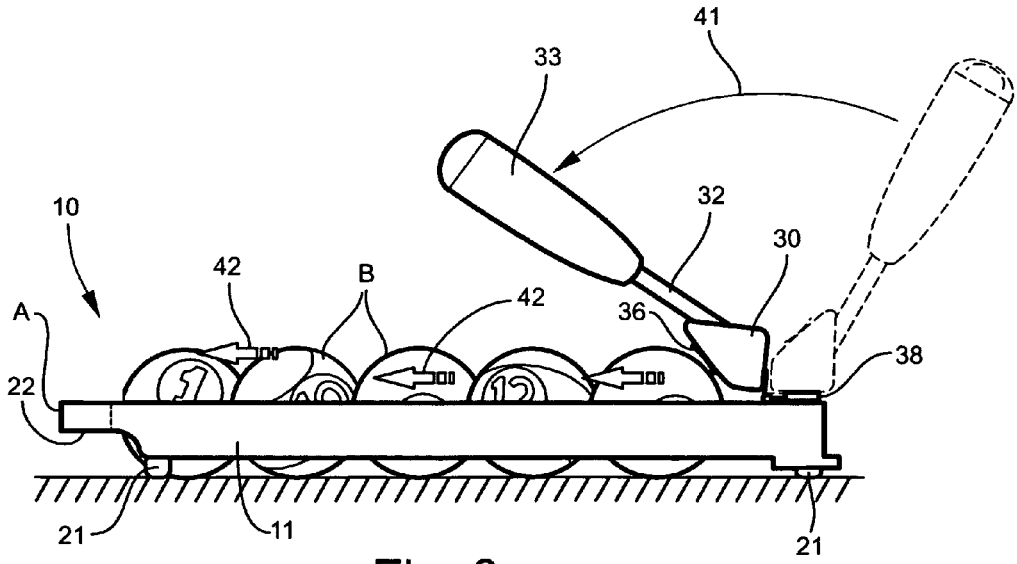
Figure 9:
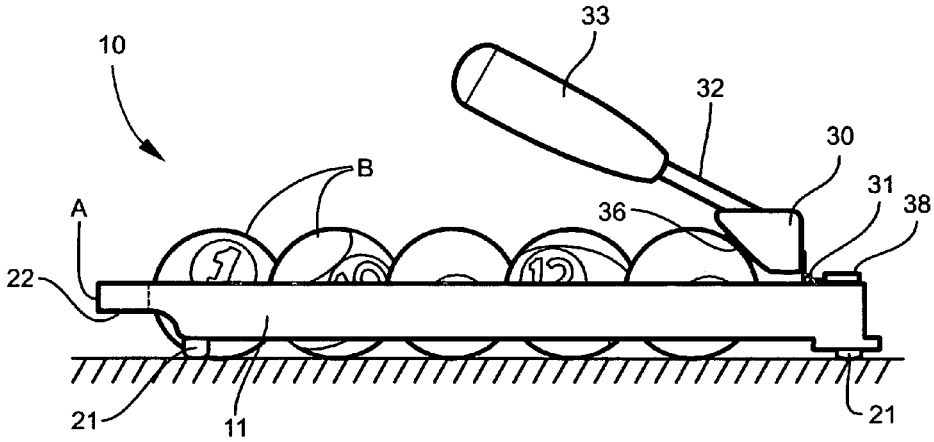
Figure 10:
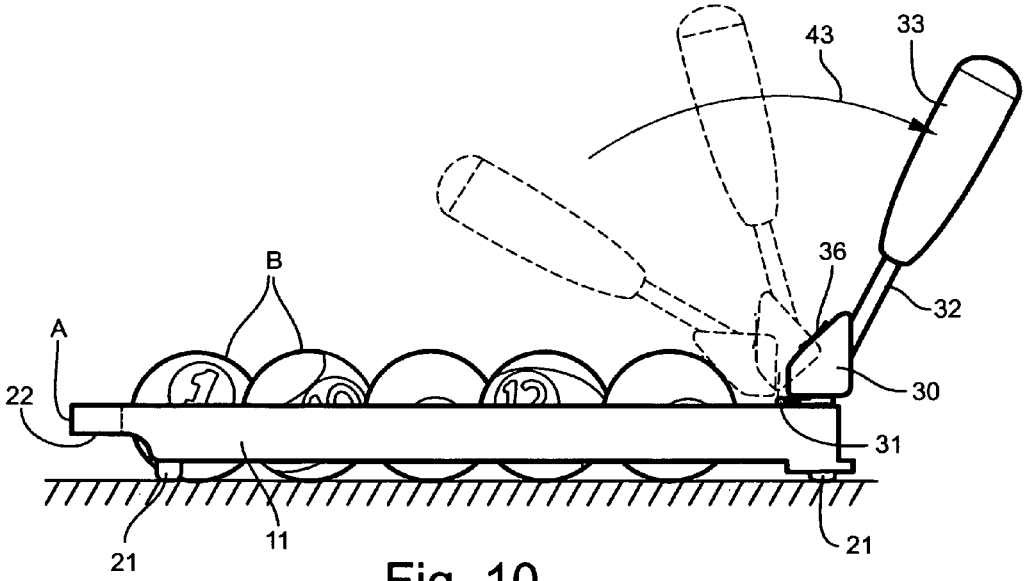
Figure 11:
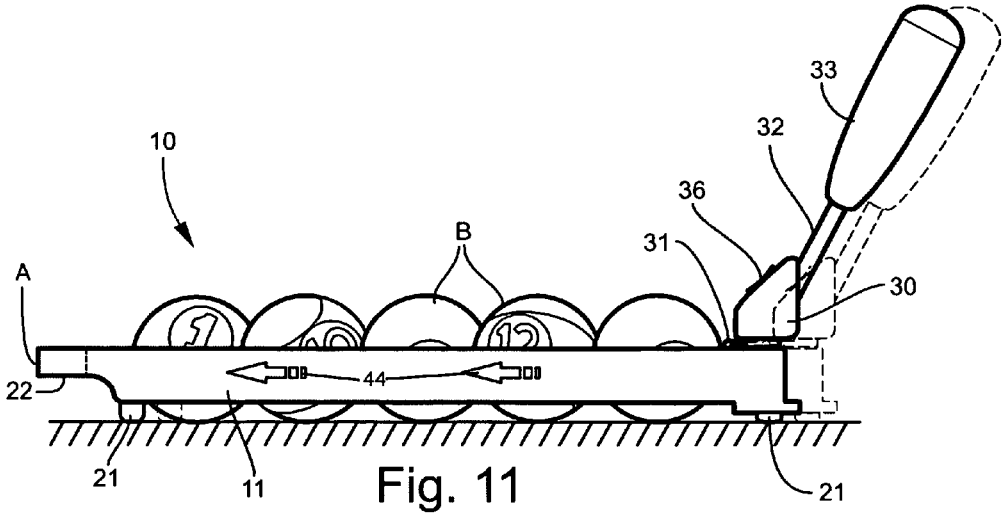

An elongated pivoted racking bar 30 is located adjacent the rear frame segment 19, and is pivotably mounted to the frame 11 by metal hinge 31, best shown in FIGS. 5 and 6. A first leaf 31A of the exemplary hinge 31 is attached to the frame 11 using suitable fastening means (e.g., screws, nails, staples, adhesives), and extends substantially continuously the entire length of the rear frame segment 19. The second hinge leaf 31B is attached in a similar manner to the pivoted racking bar 30. An outwardly-extending handle 32 is attached to the pivoted racking bar 30 centrally between its opposite ends, and has an ergonomically shaped cushioned hand grip 33 for grasping by a user. The handle 32 functions, as demonstrated in FIGS. 5 and 6, to move the racking bar 30 between a downwardly pivoted ball-engaging position and an upwardly pivoted frame-removing position. In the ball-engaging position, the pivoted racking bar 30 applies a uniform downward and angled force to a back row of billiard balls "B", thereby urging the balls forward and tightly together within the ball containment area 12 towards the apex "A" of the rigid frame 11, as indicated by direction arrows in FIG. 3, thereby reducing gaps between adjacent balls "B". A ball-engaging strip 36 of rubber (e.g., neoprene) or other resilient material may be applied by adhesive or other means to a generally flat surface area of the racking bar 30. The rubber strip 36 promotes frictional contact with the entire back row of billiard balls "B", and the forward movement of balls towards the apex "A" of frame 11. FIG. 4 illustrates the tightly organized billiard balls "B" within the ball containment area 12 after application of the racking bar 30. In the frame-removing position, the pivoted racking bar 30 is moved away from the billiard balls "B" and the handle 32 located to facilitate lifting and removal of the rack assembly 10 from the table. The racking bar 30 may be constructed of the same rigid material as frame 11, and in one embodiment is approximately 11.7 inches in length.

As shown in FIGS. 3, 5, and 6, a magnetic strip 38 is located on the rear frame segment 19 and functions to attract the metal leaf 31B of hinge 31 (or a second magnet suitably attached to the pivoted racking bar 30), thereby temporarily holding the racking bar 30 and handle 32 in the raised frame-removing position. The magnetic strip 38 may also serve as a low-profile spacer to reduce hinge stress. The magnetic strip 38 may comprise neodymium or other suitable ferromagnetic material. In alternative embodiments (not shown), the racking assembly 10 may incorporate multiple spaced-apart rectangular magnets located along the rear frame segment, or frame-embedded cylindrical magnets with disk-shaped contacts, or other complementary releaseable fasteners, such as hook and loop strips, releaseable pressure-sensitive adhesive, or the like. The exemplary handle 32 may be removably attached to the racking bar 30 by complementary screw threads, friction fit, or the like.

Figure 12:
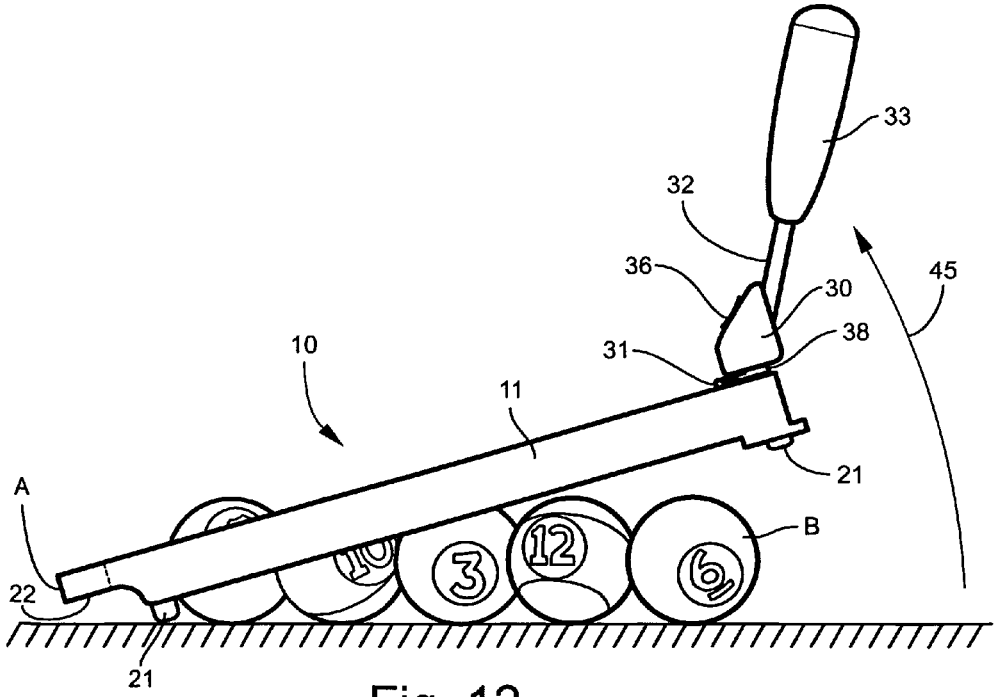
Figure 13:
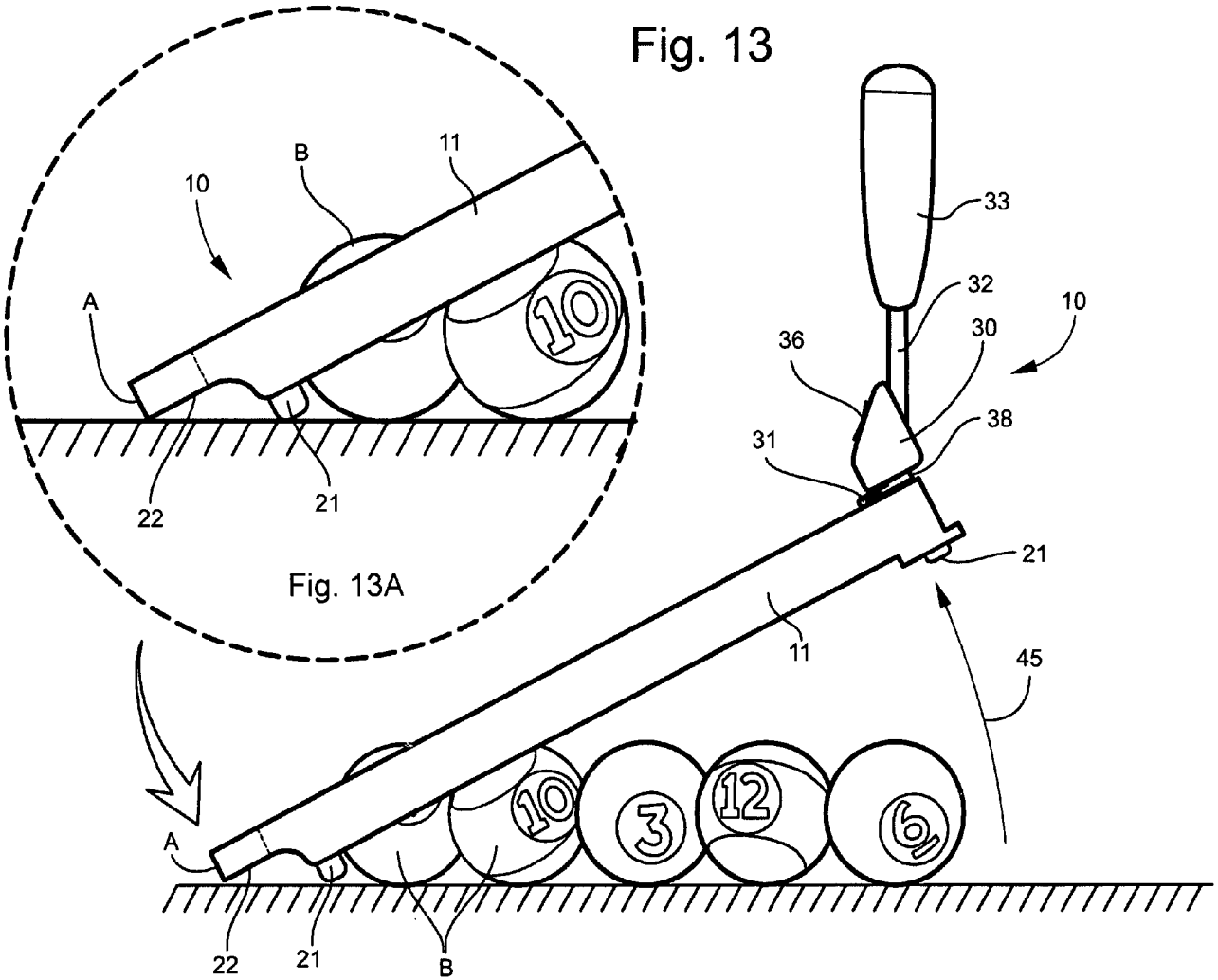
Figure 14:
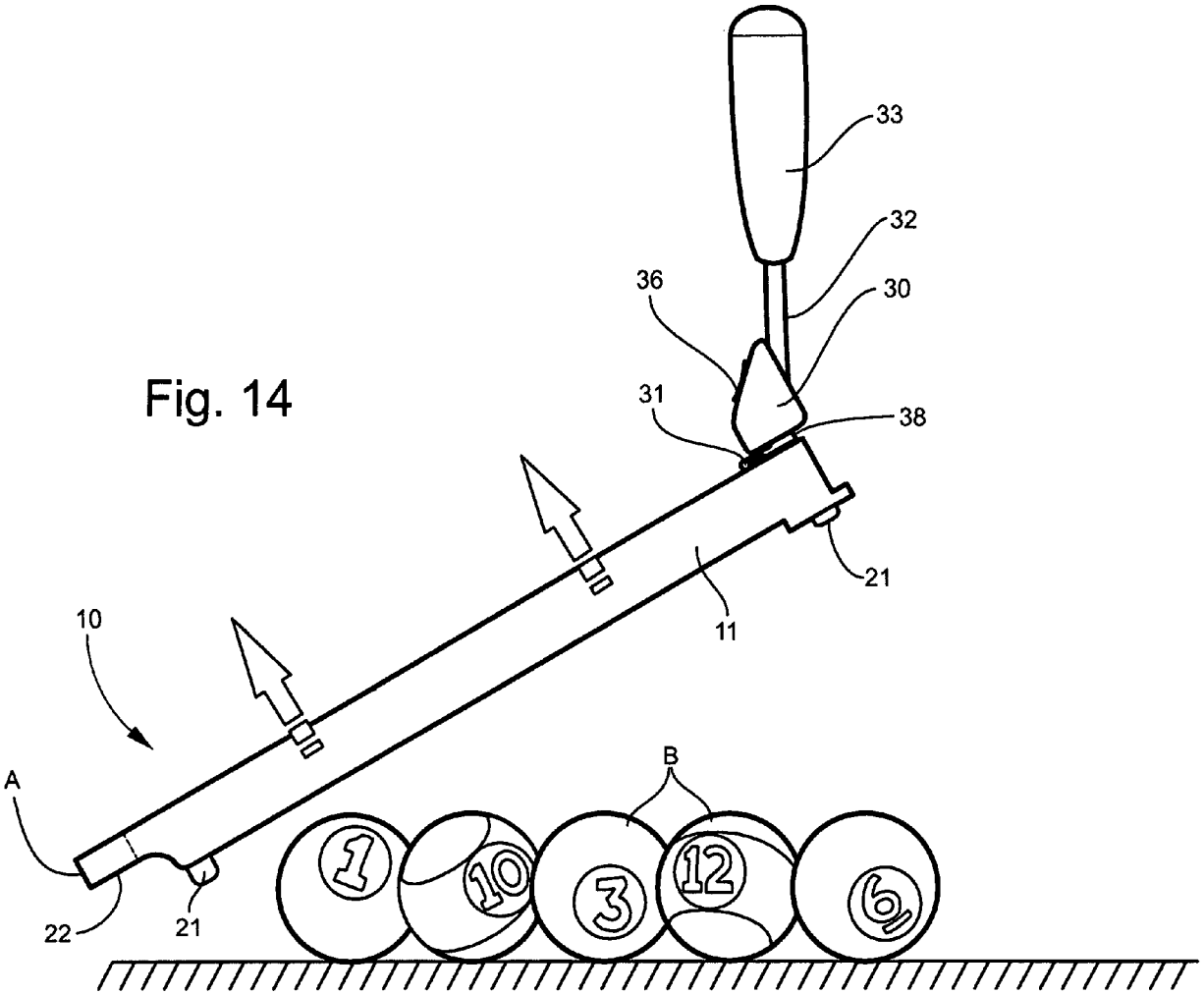

Sequential operation of the exemplary racking assembly 10 is demonstrated in FIGS. 7-14. Initially, the billiard balls "B" are collected on the table "T" and located within the ball containment area 12 defined by the rigid frame 11. The magnetic strip 38 attached to the frame 11 attracts the metal hinge 31 (or second magnet) to temporarily hold the pivoted racking bar 30 and handle 32 in the raised position shown in FIG. 7. The handle 32 is then grasped by the user, and lowered (as demonstrated by arrow 41 in FIG. 8) moving the racking bar 30 into the downwardly pivoted ball-engaging position. The pivoted racking bar 30 applies a uniform downward and angled force to a back row of billiard balls "B", as demonstrated generally at arrow "F" in FIG. 9, thereby forcing all of the balls forwardly towards the apex "A" of frame 11. See arrows 42 in FIG. 8. This action tightly organizes the balls "B" within the ball containment area 12. In the downwardly pivoted position of the racking bar 30, the ball-engaging rubber strip 36 frictionally contacts each of the billiard balls "B" in a back row immediately adjacent the rear frame segment 19. After tightening the rack, the pivoted racking bar 30 and handle 32 are returned to the raised position as indicated by arrow 43 in FIG. 10. The rigid frame 11 is then carefully slid slightly forward on table gliders 21, as indicated by arrows 44 in FIG. 11. Referring to FIGS. 12, 13, and 13A, grasping the handle 32 in the raised position, the rigid frame 11 is then tilted upward and forward (as indicated by arrow 45) at front-tilt cutout 22 and the handle 32 used to help lift and remove the frame 11 from the table "T", as demonstrated in FIG. 14, without loosening the tightly organized billiard balls For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A billiards rack assembly for tightly organizing billiard balls on a table, said rack assembly comprising:

a rigid frame defining a ball containment area;

an elongated pivoted racking bar located at one end of said rigid frame;

a hinge pivotably attaching said pivoted racking bar to said rigid frame;

a handle attached to said pivoted racking bar, and adapted for being grasped by a user to move said racking bar between a downwardly pivoted ball-engaging position and an upwardly pivoted frame-removing position, such that:

in the ball-engaging position, said pivoted racking bar forces the billiard balls tightly together within the ball containment area towards an opposite end of said rigid frame, thereby reducing gaps between adjacent balls; and in the frame-removing position, said pivoted racking bar is moved away from the billiard balls and said handle positioned to facilitate lifting and removal of said rack assembly from the table; and means for temporarily holding said pivoted racking bar in the frame-removing position.

2. The billiards rack assembly according to claim 1, wherein said rigid frame is substantially triangular and comprises three equally-spaced corners integrally formed together with opposing elongated side frame segments and an elongated rear frame segment, one of said corners defining a front apex of said frame.

3. The billiards rack assembly according to claim 2, wherein said pivoted racking bar extends substantially continuously between rear corners of said frame, such that when in the ball-engaging position, said pivoted racking bar engages a back row of billiard balls adjacent said rear frame segment and forces the billiard balls forward with the ball containment area towards the front apex of said frame.

4. The billiards rack assembly according to claim 3, wherein said hinge is an elongated hinge located on said rear frame segment and extending substantially continuously from one end of said racking bar to an opposite end of said racking bar.

5. The billiards rack assembly according to claim 4, and comprising a hinge spacer located on said rear frame segment adjacent said hinge.

6. The billiards rack assembly according to claim 2, wherein the front apex of said rigid frame defines a frame-tilt cutout.

7. The billiards rack assembly according to claim 1, and comprising a plurality of gliders located at a bottom of said rigid frame.

8. The billiards rack assembly according to claim 1, wherein said handle comprises a cushioned grip.

9. The billiards rack assembly according to claim 1, wherein said pivoted racking bar comprises a rubber ball-engaging strip extending longitudinally substantially from one end of said racking bar to the other.

10. A billiards rack assembly for tightly organizing billiard balls on a table, said rack assembly comprising:

a rigid integrally-formed triangular frame comprising three equally-spaced corners, two side frame segments, and a rear frame segment, said corners and frame segments cooperating to define a ball containment area;

an elongated pivoted racking bar adjacent said rear frame segment, and substantially continuously from one rear corner of said frame to an opposite rear corner of said frame;

a hinge pivotably attaching said pivoted racking bar to said rigid frame;

a handle attached to said pivoted racking bar, and adapted for being grasped by a user to move said racking bar between a downwardly pivoted ball-engaging position and an upwardly pivoted frame-removing position, such that:

in the ball-engaging position, said pivoted racking bar forces the billiard balls forwardly within the ball containment area towards a front apex of said rigid frame, thereby reducing gaps between adjacent balls; and in the frame-removing position, said pivoted racking bar is moved away from the billiard balls and said handle positioned to facilitate lifting and removal of said rack assembly from the table; and means for temporarily holding said pivoted racking bar in the frame-removing position.

11. The billiards rack assembly according to claim 10, wherein said hinge is an elongated metal hinge located on said rear frame segment and extending substantially continuously from one end of said racking bar to an opposite end of said racking bar.

12. The billiards rack assembly according to claim 10, wherein said means for temporarily holding said pivoted racking bar comprises a magnet.

13. The billiards rack assembly according to claim 11, and comprising a hinge spacer located on said rear frame segment adjacent said hinge.

14. The billiards rack assembly according to claim 10, wherein the front apex of said rigid frame defines a frame-tilt cutout.

15. The billiards rack assembly according to claim 10, and comprising a plurality of gliders located at a bottom of said rigid frame.

16. The billiards rack assembly according to claim 10, wherein said handle comprises a cushioned grip.

17. The billiards rack assembly according to claim 10, wherein said pivoted racking bar comprises a rubber ball-engaging strip extending longitudinally substantially from one end of said racking bar to the other.

* * * * *